United States Patent [19]

Thenander

[11] 4,102,183

[45] Jul. 25, 1978

[54] METHOD OF MINIMIZING ERRORS IN MEASURING OF TENSION IN MOVING STRIP

[75] Inventor: Rune Thenander, Vesteras, Sweden

[73] Assignee: ASEA Aktiebolag, Vesteras, Sweden

[21] Appl. No.: 824,172

[22] Filed: Aug. 12, 1977

[30] Foreign Application Priority Data

Aug. 16, 1976 [SE] Sweden ..... 76091081

[51] Int. Cl.[2] ..... G01L 5/04

[52] U.S. Cl. ..... 73/144

[58] Field of Search ..... 73/144, 143

[56] References Cited

U.S. PATENT DOCUMENTS 3,204,454 9/1965 Friman et al. ..... 73/143

3,589,181 6/1971 Palmatier ..... 73/144

FOREIGN PATENT DOCUMENTS 891,232 3/1962 United Kingdom ..... 73/144

*Primary Examiner*—Charles A. Ruehl

*Attorney, Agent, or Firm*—Watson, Cole, Grindle & Watson

[57] ABSTRACT

Errors introduced in the measuring of the tension in a moving strip passing over a measuring roll when the strip is either accelerating or decelerating thereover are minimized by adjusting the direction of measurement of the tension by the force-sensing load cells on which the measuring roll is mounted. The optimum direction for the measurement is determined using specific formulas.

1 Claim, 2 Drawing Figures

METHOD OF MINIMIZING ERRORS IN MEASURING OF TENSION IN MOVING STRIP

BACKGROUND OF THE INVENTION

The present invention relates to a method for measuring the tension in a strip or the like passing over a measuring roll. More specifically, the present invention relates to a method for accurately measuring the tension when the strip is either accelerating or decelerating in its speed of passing over a measuring roll.

When measuring the tension in a moving strip or like web, such as for example in papermaking machines it is well known to pass the strip over a measuring roll which is mounted on force-sensing load cells, and by measuring a force in a particular direction, usually horizontal, the tension in the strip can be determined. However, the known measuring system does not take into consideration inaccuracies introduced in the measured tension due to the fact that the strip may be accelerating or decelerating in speed.

It is an object of the present invention to derive a method of measuring the tension in a moving strip or the like wherein the measurement will be made to take into consideration the accelerating or decelerating nature of the moving strip.

SUMMARY OF THE INVENTION

According to the present invention the direction of measurement of the force on the load cells of the measuring roll is adjusted in accordance with specific factors, the adjusted direction providing a force reading which is different from a conventional horizontal reading and is thus reflective of the accelerating or decelerating nature of the moving strip.

The invention will be better understood in conjunction with the accompanying drawings and following discussion.

DESCRIPTION OF THE DRAWINGS

In the figures.

DETAILED DESCRIPTION OF THE INVENTION

Figure 1:
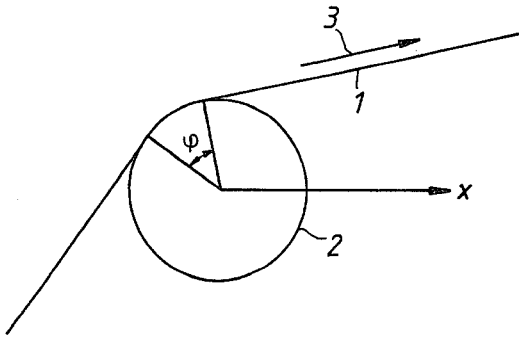
FIG. 1 schematically depicts a moving strip passing over a conventional measuring roll.

As can be seen from FIG. 1, in measuring the tension of a moving strip, the strip 1 is caused to pass over a portion of the periphery of a measuring (or bending) roll 2, e.g., in the direction indicated by arrow 3. The bending roll 2, which rotates in a clockwise direction is mounted on force-sensing load cells (not shown) such that, as is conventional, the tension on the measuring roll is measured in the X direction, i.e., along an approximately horizontal direction. The angle of wrap around the circumference of roll 2 is indicated by $\phi$.

Figure 2:
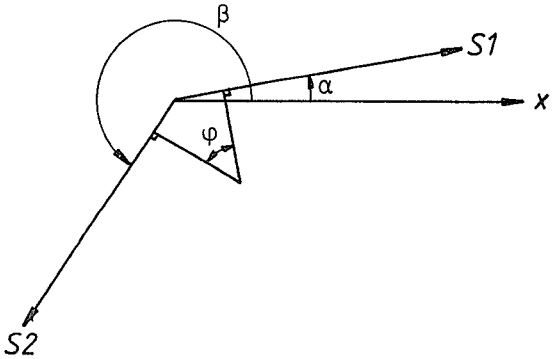
FIG. 2 depicts the tensile forces which act on the roll as the strip passes thereover.

As indicated in FIG. 2, the tension on the drawing part of strip 1 is indicated by S1 and the tension on the drawn part is S2. In addition, the angle between the initial measuring direction and the direction of passage of the drawn part of strip 1 away from the measuring roll is $\alpha$, and between the initial measuring direction and the direction opposite to the direction of passage of the drawn part towards the measuring roll is $\beta$.

Analyzing FIG. 2 in detail, during normal operation, i.e., when the strip drives the measuring roll without slipping, the following control condition applies:

$$S1 \cos\alpha + S2 \cos\beta = \text{constant}$$

When the strip, however, is accelerated, S1 becomes greater than S2 (S1/S2 $>1$) until the value $e^{\mu\phi}$ is reached, $\mu$ being the coefficient of friction and $\phi$ the wrapping angle. When S1/S2 $= e^{\mu\phi}$ the strip starts slipping over the roll.

In other words, if S1/S2 $< e^{\mu\phi}$ the strip does not slip and the control condition applies; however, if S1/S2 $= e^{\mu\phi}$, the strip slips and the control condition does not apply.

Starting from the control condition, and considering the roll under constant operation, the following applies:

$$S1 = S2 = S$$

During acceleration and retardation $S1 \neq S2$ because the roll is accelerated or retarded by the strip. The following equation can then be made in accordance with the control condition:

$$S1 \cos\alpha + S2 \cos\beta = \cos\alpha + S \cos\beta \quad (1)$$

An analysis of equilibrium of the forces in the strip results in $$S1 - S2 = F_{acc} \quad (2)$$

where $F_{acc}$ is the force required to accelerate the roll.

(1) + (2) results in $$S1 \cos\alpha + (S1 - F_{acc}) \cos\beta = S (\cos\alpha + \cos\beta)$$

$$S1 (\cos\alpha + \cos\beta) - F_{acc} \cos\beta = S (\cos\alpha + \cos\beta)$$

$$S1 = S + F_{acc} \cdot \cos\beta / \cos\alpha + \cos\beta \quad (3)$$

In the same way S2 is obtained from (1) and (2):

$$S2 = S - (F_{acc} \cdot \cos\alpha / \cos\alpha + \cos\beta) \quad (4)$$

The load cells on the measuring roll indicate the force S. During an acceleration cycle the tensions in the drawing and in the drawn part of strip 1 are S1 and S2, respectively, according to equations (3) and (4). The errors in S1 and S2, because of the acceleration (or deceleration) will be $$\Delta S1 = S1 - S = (F_{acc} \cos\beta / \cos\alpha + \cos\beta) \quad (5)$$

$$\Delta S2 = S2 - S = -(F_{acc} \cos\alpha / \cos\alpha + \cos\beta) \quad (6)$$

Thus, in order to minimize the errors in measuring the tension in a moving strip when the strip is accelerating or decelerating over a conventional measuring roll, the following steps are followed.

First of all, the angle $\alpha$ is determined. Then the angle $\beta$ is determined (in this regard, usually the direction of movement of the drawing part and the drawn part of a moving strip over a measuring roll are predetermined for a given situation). Next, the force necessary to accelerate the particular measuring roll ($f_{acc}$) is calculated using the values of the roll weight, the roll dimensions and the time required to accelerate the roll to full speed. Then, noted formulas (5) and (6) are utilized to determine which angles $\alpha$ and $\beta$ will result in the lowest $\Delta S1$ and/or $\Delta S2$ (calculations can, if desired, be done by computer). Knowing these values, the direction of measurement, which is initially indicated by generally horizontal direction X, is adjusted to a direction X' to provide the most accurate tension value. This adjustment of direction (to direction X') can be achieved by (obvious) adjustment of the direction of tension measurement force-sensing load cells upon which the measuring roll is mounted. For example, the plate upon which a conventional force-sensing load cell is mounted can be pivoted along one of its edges by adjustment of the height of the opposite edge, e.g., by means of a screw adjustment.

Of course, during all the foregoing steps the acceleration or deceleration of the strip 1 is maintained such that slipping of the strip over the periphery of roll 2 is avoided.

I claim:

1. A method for determining the tension in a moving strip by measuring the force along a direction on load cells at the ends of a measuring roll over the periphery of which the strip is partially wrapped and wherein the errors in measuring the tension when the strip is accelerating or decelerating in speed are minimized, the steps including (1) measuring an angle $\alpha$ between an initial generally horizontal measuring direction X passing through the load cells and the predetermined direction of passage of the strip away from the periphery of the measuring roll:

(2) measuring an angle $\beta$ between the initial generally horizontal measuring direction X passing through the load cells and the direction opposite to the predetermined direction of passage of the strip towards the periphery of the measuring roll:

(3) calculating the force $F_{acc}$ needed to accelerate the measuring roll;

(4) calculating both $\Delta S1$ and $\Delta S2$ from the following formulas $$\Delta S1 = F_{acc} \cdot (\cos \beta / \cos \alpha + \cos \beta)$$

and $$\Delta S2 = - F_{acc} (\cos \alpha / \cos \alpha + \cos \beta)$$

wherein S1 is the tension on the strip in the direction of passage of the strip away from the measuring roll and S2 is the tension on the strip in the direction opposite to the direction of movement of the strip towards the measuring roll, (5) determing the angles $\alpha$ and $\beta$ such that either one or both of $\Delta S1$ or $\Delta S2$ is a minimum and thereby determining the direction $X^1$ which corresponds to such minimum, and (6) measuring the tension on said load cells at the ends of the measuring roll along the direction $X^1$.

* * * * *